United States Patent [19]

Curtis

[11] 3,963,375

[45] June 15, 1976

[54] TIME DELAYED SHUT-DOWN CIRCUIT FOR RECIRCULATION PUMP

[76] Inventor: George C. Curtis, 2701 SE. 87th, Portland, Oreg. 97266

[22] Filed: Mar. 12, 1974

[21] Appl. No.: 450,300

[52] U.S. Cl. ..... 417/12; 417/38

[51] Int. Cl.[2] ..... F04B 49/00

[58] Field of Search ..... 417/12, 38, 44; 318/484

[56] References Cited

UNITED STATES PATENTS

| | | | |
|---|---|---|---|
| 2,661,697 | 12/1953 | Long | 417/12 |
| 2,741,986 | 4/1956 | Smith | 417/12 |
| 2,741,987 | 4/1956 | Murphy | 417/44 |
| 2,765,743 | 10/1956 | Hollinshead | 417/44 |
| 2,981,195 | 4/1925 | Payne et al. | 417/12 |
| 3,030,890 | 4/1962 | Galik | 318/484 |

*Primary Examiner*—William L. Freeh
*Assistant Examiner*—G. P. La Pointe

[57] ABSTRACT

A circuit is provided for shutting off the motor of an intermittently activated, electrically powered fluid recirculation pump to prevent the pump motor from burning out its windings or bearings. A power control relay is energized to activate the pump motor for a predetermined period of time, allowing the pump to reach steady state flow condition, after which a time delay relay opens and current flows to the power control relay through a pressure switch. The pressure switch opens to shut-off the recirculation pump motor whenever the pump discharge pressure falls below a predetermined minimum.

1 Claim, 1 Drawing Figure

TIME DELAYED SHUT-DOWN CIRCUIT FOR RECIRCULATION PUMP

Figure 1:
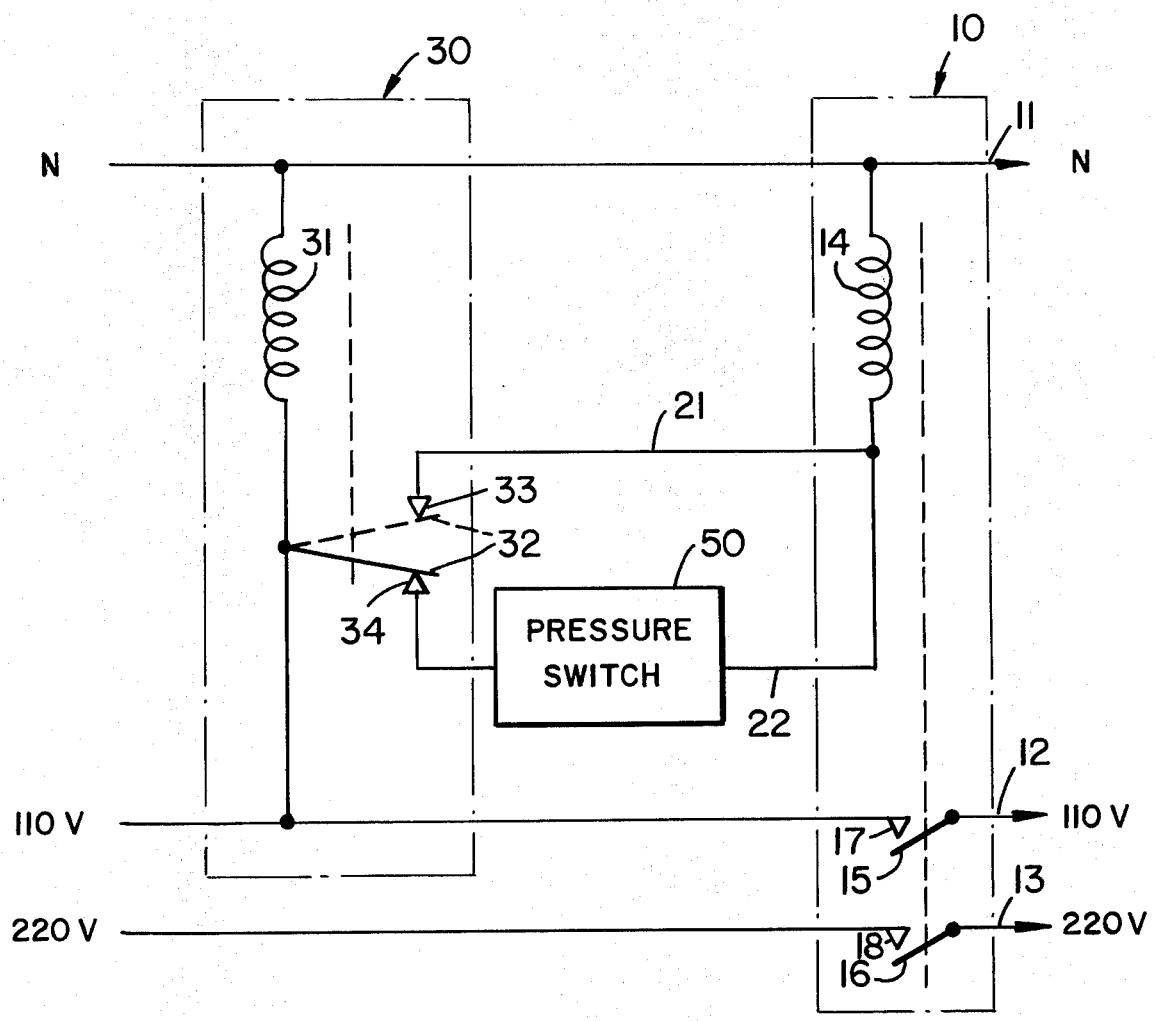

This invention relates generally to fluid recirculation pumps and more specifically to recirculation pumps used in conventional swimming pools.

If the water level of a swimming pool drops either by evaporation or by reason of a leak in the water recirculation system, when the recirculation pump is activated, its starts sucking air and loses its prime. The pump then may continue to run without pumping any water, which might result in destruction of the motor windings or bearings.

The instant invention provides a circuit which activates the recirculation pump for a predetermined period of time, for example, three minutes, and then switches the power supply through an alternate branch containing a pressure switch. If the discharge pressure of the recirculation pump is below a predetermined minimum level, the pressure switch shuts off power to the control relay and the motor is shut down.

A primary object of this invention is to provide a circuit for shutting down an intermittently activated, fluid circulation pump whenever the discharge pressure of the pump is below a predetermined level.

A further object of this invention is to provide a circuit for use in conjunction with swimming pool recirculation pumps which protects the pump motor from burning out whenever the pump loses its prime and starts sucking air.

A further object of this invention is to provide a circuit for activating a swimming pool recirculation pump, allowing the pump to reach a state of equilibrium, and thereafter switching the power supply to the pump motor through a pressure switch which shuts off the power to the motor if a sufficient pump discharge pressure has not been attained.

A still further object of this invention is to provide a circuit for use in conjunction with swimming pool recirculation pumps which activates the pump when desired for a period of three minutes, thereby allowing the pump to reach a steady state operation, and thereafter switches the power through an alternate branch having a pressure switch which protects the pump motor from burning out by pumping air.

Further objects and advantages of this invention will become apparent from the following description of the preferred embodiment and the drawing, wherein:

FIG. 1 is a schematic diagram showing the circuit of this invention.

Lines 12 and 13 are two phase, 110 volt lines. A swimming pool recirculation pump is connected between the neutral or ground line 11 and lines 12 and 13 for 220 volt operation.

Reference numeral 10 refers to a power control relay. Power control relay 10 is a double pole, single throw relay. Coil 14 is energized as hereafter described and when energized, contacts 15 and 16 are closed against contacts 17 and 18 respectively, supplying power to the recirculating pump motor (not shown). Power control relay 10 is shown in its open position in FIG. 1. In this position, relay 10 shuts off power to the pump motor.

Time delay relay 30 is a single pole double throw relay having coil 31 and contacts 32, 33 and 34. In operation, contact 32 either makes an electrical connection with contact 33 or with contact 34. As shown in FIG. 1, time delay relay is shown in its open position.

When relay 30 is energized, contact 32 is drawn into position to make an electrical connection with contact 33, as shown in dashed lines. When time delay relay 30 is energized, current flows through first branch 21 directly through the coil 14 of power control relay 10. Power control relay 10 then closes and the pump motor is activated. The pump begins recirculating the swimming pool water and after passing through a transient period, the pump attains a steady state flow condition after a period of about three minutes.

After approximately 3 minutes have passed, time delay relay 30 is deenergized and contact 32 goes to its open position wherein it makes an electrical connection with contact 34, thereby making electrical contact with second branch 22 between time delay relay 30 and power control relay 10. Second branch 22 is parallel with first branch 21.

Pressure switch 50 is located in second branch 22. Pressure switch 50 senses the discharge pressure of the recirculating pump. Assuming that the pump has retained its prime, and is properly circulating water under pressure through the swimming pool, pressure switch 50 remains closed, thereby energizing power control relay 10 through second branch 22.

If the pump has not retained its prime, as for example when a substantial amount of water in the pool has evaporated, the pump will run for three minutes, but when the 3 minute period expires and time delay relay 30 is deenergized and opens, an electrical contact is made between contacts 32 and 34, but pressure switch 50 is open and therefore power control relay 10 is deenergized, thereby separating contacts 15 and 16 from contacts 17 and 18 respectively and shutting off all power to the pump motor.

Pressure switch 50 is an adjustable low limit switch which uses a predetermined limit. In the embodiment shown, a limit of 6 pounds plus or minus 1 pound per square inch is used. The pump, when operating in proper fashion and properly primed with water, will pump at pressures in excess of the predetermined limit, which in the embodiment shown is 7 pounds per square inch. When the pump has lost its prime and sucks air, the discharge pressure falls below the predetermined limit, which in the embodiment shown is 5 pounds per square inch, thereby opening pressure switch 50. Pressure switch 50 is connected directly to the bottom drain of the pump volute by means of a ¼ inch line.

In operation, the circuit shown in FIG. 1 is used to control the power input to a swimming pool recirculation pump. It is desirable to activate the pump intermittently in order to maintain the proper circulation in the pool. Time delay relay 30 is energized whenever the recirculation pump is to be activated. Relay 30 may be energized by means of a manual switch (not shown) or by automatic timing means (not shown). Such means for energizing relay 30 form no part of this invention. When the electrically powered fluid recirculation pump is activated by energizing the coil 31 of time delay relay 30, power flows through first branch 21, thereby energizing power control relay 10 and driving the pump motor for 3 minutes. At the end of 3 minutes, time delay relay 30 is deenergized and power flows through branch 22 so long as pressure switch 50 is closed. Pressure switch 50 opens when the recirculation pump is sucking air or for some other reason has not attained the proper discharge pressure.

I claim:

1. A circuit for controlling the application of electrical power to a pump motor, comprising a plurality of electrical conductors adapted to be connected to an electrical pump motor for applying electrical power thereto, a first relay having a pair of cooperating contacts in at least one of said conductors for controlling the flow of current therethrough, a second relay having a coil connected between two of said conductors, said second relay thereby being actuated upon the application of an electrical potential between said two conductors, one end of the coil of said first relay being connected to a first of said two conductors and the other end thereof being connected to a first fixed contact of said second relay, said other end of said coil of said first relay also being connected to a second fixed contact of said second relay through a pressure-sensitive switch adapted to sense the output pressure of a pump driven by such motor, said pressure-sensitive switch being adapted to open and interrupt the connection between said first relay coil and said second fixed contact of said second relay for sensed pressures less than a predetermined minimum, and a movable contact on said second relay connected to a second of said two conductors and contacting said first fixed contact when said second relay is first actuated, said second relay being adapted to return to a de-energized condition upon the expiration of a predetermined period of time, moving said movable contact into contact with said second fixed contact, whereby energization of an associated pump motor is assured for a predetermined period of time irrespective of the output pressure of the associated pump, after which period of time the pump motor will be de-energized when such output pressure drops below a predetermined level.

* * * * *